US011246396B2

(12) United States Patent
Boos

(10) Patent No.: US 11,246,396 B2
(45) Date of Patent: Feb. 15, 2022

(54) MODULAR CABINET SHELF

(71) Applicant: Joshua B. Boos, Milton, NY (US)

(72) Inventor: Joshua B. Boos, Milton, NY (US)

( * ) Notice: Subject to any disclaimer, the term of this patent is extended or adjusted under 35 U.S.C. 154(b) by 0 days.

(21) Appl. No.: 17/009,037

(22) Filed: Sep. 1, 2020

(65) Prior Publication Data

US 2021/0059385 A1 Mar. 4, 2021

Related U.S. Application Data

(60) Provisional application No. 62/895,263, filed on Sep. 3, 2019.

(51) Int. Cl.

| | |
|---|---|
| ***A47F 5/00*** | (2006.01) |
| ***A47F 5/12*** | (2006.01) |
| ***A47B 96/02*** | (2006.01) |
| ***A45D 44/02*** | (2006.01) |
| ***A47F 7/28*** | (2006.01) |

(52) U.S. Cl.

CPC ..... *A45D 44/02* (2013.01); *A47B 96/021* (2013.01); *A47F 5/0043* (2013.01); *A47F 5/12* (2013.01); *A47F 7/28* (2013.01)

(58) Field of Classification Search

CPC ..... A45D 44/02; A47F 5/0043; A47F 5/12; A47F 7/28; A47F 5/0018; A47B 57/04; A47B 57/06; A47B 57/08; A47B 57/20; A47B 96/02; A47B 96/021; A47B 55/00; A47B 57/045; A47B 96/027; A47B 57/16; A47B 57/18; A47B 96/024; A47B 96/028

USPC ..... 211/187, 150, 190; 312/51, 408, 351; 108/106, 107; 248/239, 241, 242, 243, 248/250

See application file for complete search history.

(56) References Cited

U.S. PATENT DOCUMENTS

| | | | | | |
|---|---|---|---|---|---|
| 754,817 | A * | 3/1904 | Schriefer | A47B 57/16 | 108/109 |
| 985,222 | A * | 2/1911 | Stuck | A47B 57/16 | 108/110 |
| 1,876,172 | A * | 9/1932 | Ruddy | A47B 57/04 | 108/6 |
| 1,937,935 | A * | 12/1933 | Zimmerman | A47B 57/16 | 108/110 |
| 2,926,978 | A * | 3/1960 | Mitchell | A47B 47/03 | 312/108 |
| 2,933,195 | A | 4/1960 | Radek | | |

(Continued)

*Primary Examiner* — Jennifer E. Novosad

(74) *Attorney, Agent, or Firm* — Daniel J. Polglaze; Westman, Champlin & Koehler, P.A.

(57) ABSTRACT

A shelf includes a first side edge and a second opposite side edge; a first lateral edge extending between the first and second side edges and having a lip extending substantially perpendicular to and away from a top surface of the shelf; and a second opposite lateral edge, extending between the first and second side edges and having a first lip extending substantially perpendicular to and away from a bottom surface of the shelf, and a second lip extending substantially perpendicular to the first lip back toward the shelf. Each of the side edges has tabs extending substantially perpendicular to and away from the bottom surface of the shelf, the tabs defining slots between respective tabs, and a slot between the first and second lips and one of the tabs. A tab most distal from the second laterally extending edge has a curved to engage a pin.

16 Claims, 10 Drawing Sheets

(56) References Cited

U.S. PATENT DOCUMENTS 3,010,585 A * 11/1961 Slikkers ..... A47B 57/16 108/1
3,044,631 A * 7/1962 Greenman ..... A47B 57/04 108/1
3,115,254 A * 12/1963 Lawrence ..... A47B 57/04 211/134
3,534,863 A * 10/1970 Howard ..... A47F 7/163 211/47
3,570,679 A * 3/1971 Edson ..... A47F 7/163 211/47
3,846,944 A 11/1974 Lambert
4,073,556 A * 2/1978 Wilson, Jr. ..... A47B 57/16 312/7.2
4,193,650 A 3/1980 Gray et al.
4,332,204 A * 6/1982 Hewell ..... A47F 5/12 108/1
4,531,646 A * 7/1985 Howard ..... A47F 5/12 108/6
4,540,222 A * 9/1985 Burrell ..... A47F 3/00 211/175
5,048,699 A * 9/1991 Trevaskis ..... A47F 5/12 211/59.2
5,127,340 A * 7/1992 Maro ..... A47B 57/00 108/107
5,152,491 A * 10/1992 Forster ..... A47B 19/08 248/454
5,306,077 A * 4/1994 Trevaskis ..... A47F 3/063 312/122
5,349,909 A * 9/1994 Smit ..... A47B 96/06 108/107
5,364,178 A 11/1994 Hofman et al.
5,487,474 A * 1/1996 Heimendinger ..... A47F 1/12 211/1.57
5,645,176 A * 7/1997 Jay ..... A47F 1/12 211/59.2
5,716,116 A 2/1998 Carlson et al.
5,762,213 A * 6/1998 Heneveld, Sr. ..... A47B 96/04 211/187
5,816,419 A * 10/1998 Lamson ..... A47B 57/045 211/150
5,890,606 A 4/1999 Kuipers
6,006,926 A * 12/1999 O'Reilly ..... A47B 57/04 211/133.1
6,170,674 B1 * 1/2001 Caterinacci ..... A47F 7/0042 211/41.1
6,584,916 B1 * 7/2003 Felton ..... A47B 46/005 108/107
6,705,477 B1 3/2004 Narkis et al.
7,350,649 B1 * 4/2008 Martens ..... A47B 57/06 211/150
7,743,932 B2 6/2010 Lynch
8,813,980 B1 8/2014 Billman
10,159,341 B1 12/2018 Thompson et al.
2004/0256341 A1 12/2004 Donnell et al.
2006/0175945 A1 8/2006 Deguchi
2007/0252496 A1 11/2007 Remondino
2017/0055709 A1 * 3/2017 Nowe ..... A01G 9/143
2019/0357699 A1 11/2019 Sudds et al.
2021/0059385 A1 * 3/2021 Boos ..... A45D 44/02

* cited by examiner

MODULAR CABINET SHELF

CROSS-REFERENCE TO RELATED APPLICATION

The present application is based on and claims the benefit of U.S. provisional patent application Ser. No. 62/895,263, filed Sep. 3, 2019, the content of which is hereby incorporated by reference in its entirety.

BACKGROUND

Hair salons utilize many different hair-color-lines, of which there are multiple shades within a hair-color-line. Further, the dimensions of hair-color boxes or bottles differ one from the next. This leads to multiples of the same product being opened, inventory not on hand, and time wasted searching for a desired product.

Other systems/devices dictate to a user what the system/device is able to hold within the predetermined/unadjustable subsections provided. The opened product is usually in an area where a user may not retrieve the unopened product easily.

SUMMARY

In one embodiment, a shelf configurable to be installed in a frame in one of a plurality of multiple orientations including level and tilted includes a first side edge and a second side edge opposite the first side edge; a first laterally extending edge extending between the first and second side edges, the first laterally extending edge having a lip extending substantially perpendicular to and away from a top surface of the shelf; and a second laterally extending edge, opposite the first laterally extending side edge, and extending between the first and second side edges, the second laterally extending edge having a first lip extending substantially perpendicular to and away from a bottom surface of the shelf, and a second lip extending substantially perpendicular to the first lip back toward the shelf, to thereby form a pocket. Each of the side edges has a plurality of tabs extending substantially perpendicular to and away from the bottom surface of the shelf, the plurality of tabs defining a plurality of slots between respective tabs, and a slot between the first and second lips and one of the tabs, and wherein a tab most distal from the second laterally extending edge has a curved radius therein shaped to engage a pin.

In another embodiment, a method of mounting a shelf into a cabinet includes mounting a shelf on mounting pins in the cabinet. The shelf includes a first side edge and a second side edge opposite the first side edge; a first laterally extending edge extending between the first and second side edges, the first laterally extending edge having a lip extending substantially perpendicular to and away from a top surface of the shelf; a second laterally extending edge, opposite the first laterally extending side edge, and extending between the first and second side edges, the second laterally extending edge having a first lip extending substantially perpendicular to and away from a bottom surface of the shelf, and a second lip extending substantially perpendicular to the first lip back toward the shelf, to thereby form a pocket. Each of the side edges has a plurality of tabs extending substantially perpendicular to and away from the bottom surface of the shelf, the plurality of tabs defining a plurality of slots between respective tabs, and a slot between the first and second lips and one of the tabs, and wherein a tab most distal from the second laterally extending edge has a curved radius therein shaped to engage a pin. Mounting includes engaging front and back cabinet pins level with each other with the curved radius and at least one of the slots.

In additional aspects of this embodiment, mounting is accomplished by positioning the lip of the first laterally extending edge facing upward and toward a back of the frame; placing the curved radius on a first pair of mounting pins positioned in first and second opposite side panels of the cabinet near a back thereof; positioning the second laterally extending edge above the first pair of mounting pins; and rotating the second laterally extending edge down, pivoting the shelf about the curved radius, to engage a second pair of mounting pins positioned in the first and the second opposite side panels of the cabinet near a front thereof. Further, slots of the shelf engage the second pair of mounting pins. Still further, the first pair of mounting pins and the second pair of mounting pins are at a same height and the shelf is mounted in a level position when engaged with the first and second pairs of mounting pins, the lip of the first laterally extending edge forming a back retaining element for items placed on the shelf.

In additional aspects of this embodiment, mounting is in a tilted position and is accomplished by positioning the lip of the first laterally extending edge facing upward and toward a front of the frame; placing the curved radius on a first pair of mounting pins positioned in first and second opposite side panels of the cabinet near a front thereof; positioning the second laterally extending edge above the first pair of mounting pins; and rotating the second laterally extending edge down, pivoting the shelf about the curved radius, to engage a second pair of mounting pins positioned in the first and the second opposite side panels of the cabinet near a rear thereof. Further, slots of the shelf engage the second pair of mounting pins. Still further, the first pair of mounting pins are at a lower height than the second pair of mounting pins, and the shelf is installed in a tilted position, the lip of the first laterally extending edge forming a front retaining element for items placed on the shelf.

In additional aspects of this embodiment, mounting is as a top inner cover installation for the cabinet, and is accomplished by positioning the lip of the first laterally extending edge facing downward and toward a back of the frame; placing the curved radius on a first pair of mounting pins positioned in first and second opposite side panels of the cabinet near a back thereof; positioning the second laterally extending edge below the first pair of mounting pins; rotating the second laterally extending edge up, pivoting the shelf about the curved radius, to engage the pocket with a second pair of mounting pins positioned in the first and the second opposite side panels of the cabinet near a front thereof; and placing a third pair of mounting pins, one on each opposite side of the cabinet, in slots of the shelf to secure against front to back motion of the shelf.

In another embodiment, a cabinet includes a frame, comprising a top pan and a bottom pan, and a pair of sides coupled to the top pan and the bottom pan to form the frame. At least one of the top pan and the bottom pan comprises a shelf according to the first embodiment. A shelf is adjustably mounted in the frame in one of a substantially level or a slanted orientation, the shelf being a shelf according to the first embodiment.

In another embodiment, a cabinet includes a frame including a top pan and a bottom pan, and a pair of frame sides coupled to the top pan and the bottom pan, the pair of frame sides having a plurality of openings therein to accommodate mounting pins in various configurations; and at least one shelf mountable in multiple positons to the frame on mounting pins in the frame. The shelf includes a first side edge and a second side edge opposite the first side edge; a first laterally extending edge extending between the first and second side edges, the first laterally extending edge having a lip extending substantially perpendicular to and away from a top surface of the shelf; and a second laterally extending edge, opposite the first laterally extending side edge, and extending between the first and second side edges, the second laterally extending edge having a first lip extending substantially perpendicular to and away from a bottom surface of the shelf, and a second lip extending substantially perpendicular to the first lip back toward the shelf, to thereby form a pocket. Each of the side edges has a plurality of tabs extending substantially perpendicular to and away from the bottom surface of the shelf, the plurality of tabs defining a plurality of slots between respective tabs, and a slot between the first and second lips and one of the tabs, and wherein a tab most distal from the second laterally extending edge has a curved radius therein shaped to engage a pin.

In additional aspects of this embodiment, the plurality of slots accommodate the mounting pins to mount the shelf within the frame. Further, the shelf is mounted horizontally in one aspect with the lip of the first laterally extending edge toward a back of the cabinet and extending upward. Still further, the shelf is mounted tilted in another aspect with the lip of the first laterally extending edge lower than the first and second lip of the second laterally extending edge, and the lip of the first laterally extending edge toward a front of the cabinet and extending upward. Still further, the shelf is mounted horizontally in another aspect as a top inner pan of the cabinet with the lip of the first laterally extending edge toward a back of the cabinet and extending downward. In another aspect, at least one of the top pan and the bottom pan comprises a shelf of the at least one shelf.

This summary is not intended to describe each disclosed embodiment or every implementation of the modular shelf and methods as described herein. Many other novel advantages, features, and relationships will become apparent as this description proceeds. The figures and the description that follow more particularly exemplify illustrative embodiments.

DETAILED DESCRIPTION

The shelf embodiments of the present disclosure are capable of installation in a number of different configurations into a cabinet such as a modular cabinet having standard shelf pin holes for pins for flat installation of the shelf, as well as additional pin holes for pins to allow tilted installation of the shelf. Holes in the shelf are usable to divide and subdivide the shelf by height and width of product/s' dimensions, as described in detail in commonly owned and co-pending U.S. patent application Ser. No. 16/265,302, filed on Feb. 1, 2019, and entitled MODULAR CABINET THAT DIVIDES AND SUBDIVIDES PRODUCT ACCORDING TO ITS DIMENSIONS, the contents of which are hereby incorporated by reference in their entirety.

As stated above, hair salons utilize many different hair-color-lines, of which there are multiple shades within a hair-color-line. Further, the dimensions of hair-color boxes or bottles differ one from the next. This leads to multiples of the same product being opened, inventory not on hand and time wasted searching for a desired product. Embodiments of the present disclosure provide a modular and adjustable cabinet that may be assembled to provide easy access to open product, and unopened product when no opened product is available, or when opened product is finished.

The shelf embodiments of the present disclosure allow for a single shelf to be installed in numerous ways depending upon a desired configuration of product to be displayed in the cabinet.

Figure 1:
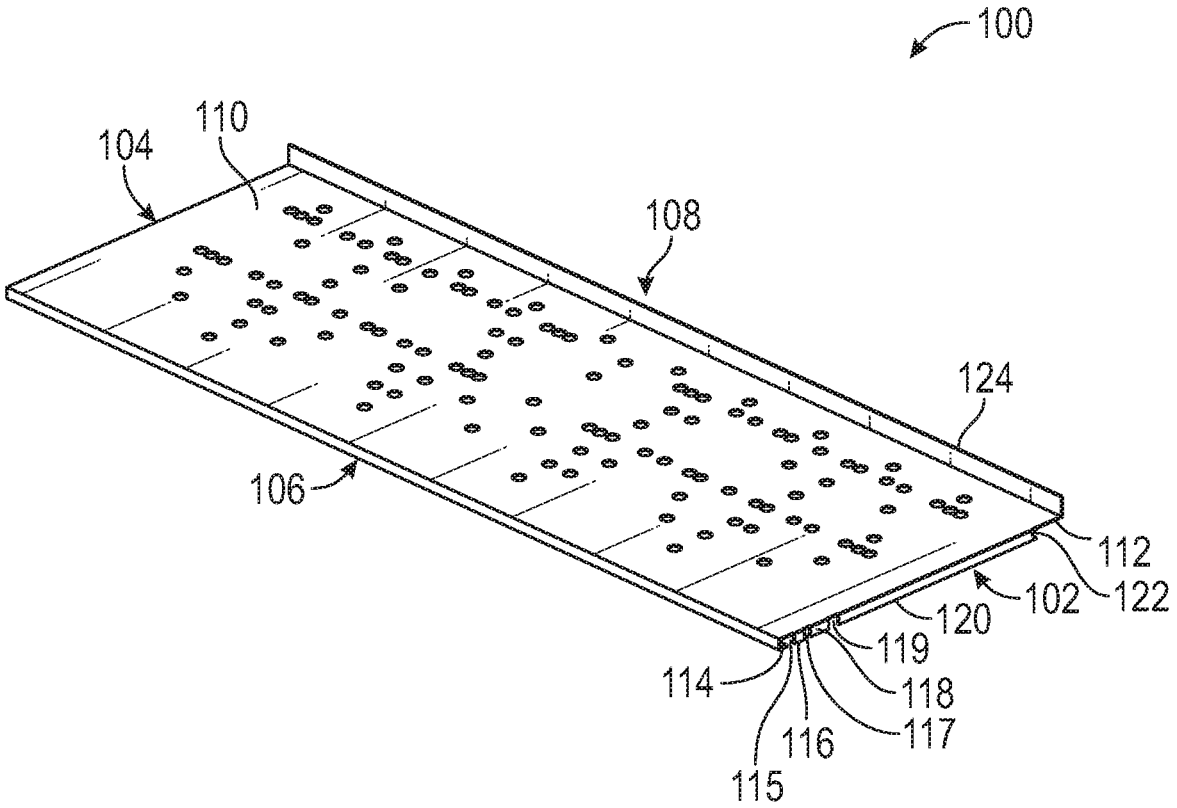
FIG. 1 is a perspective view of a shelf according to an embodiment of the present disclosure.

A perspective view of a shelf 100 according to an embodiment of the present disclosure is shown in FIG. 1. Shelf 100 includes shelf first side edge 102 and second side edge 104, and first laterally extending edge 106 and second laterally extending edge 108. Lateral extending edges 106, 108 are, in different installation configurations of the shelf 100, front or rear edges with respect to a cabinet into which the shelf 100 is installed. Shelf 100 has a first shelf surface 110 and a second shelf surface 112. Shelf surfaces 110, 112 are, in different installation configurations of the shelf 100, top or bottom surfaces with respect to a cabinet into which the shelf 100 is installed.

Side edges 102 and 104 each have a folded lip tab 114 extending from edge 106 to form a pocket 125 between the lip tab 114 and the bottom surface 110 of the shelf 100, and three edge tabs 116, 118, and 120. Edge tabs 116, 118, and 120 extend substantially perpendicular to surface 112, forming a substantially right angle therewith. Slots are present between tabs, with a slot 115 between curled lip tab 114 and tab 116, a slot 117 between tab 116 and tab 118, and a slot 119 between tab 118 and tab 120. At a distal end of tab 120 from slot 119, a rounded radius indentation/cutout 122 is present. A lateral edge tab 124 extends substantially perpendicular to surface 110, forming a substantially right angle therewith.

Figure 7:
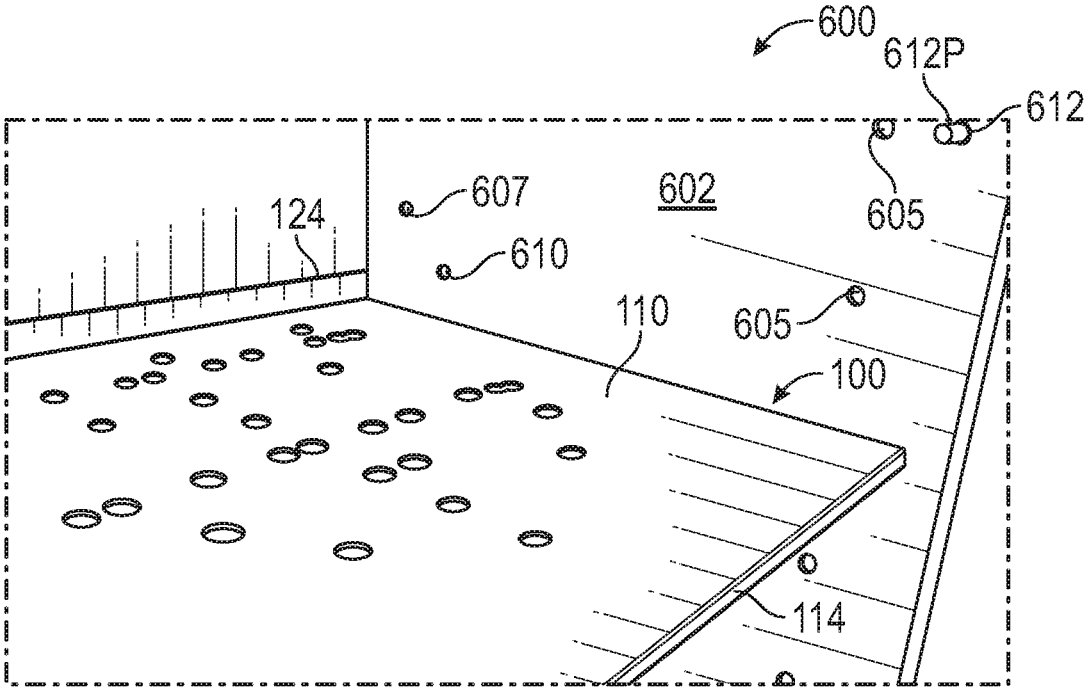
FIG. 7 is a top perspective view of a shelf installed in a frame in a flat configuration according to an embodiment of the present disclosure.
Figure 8:
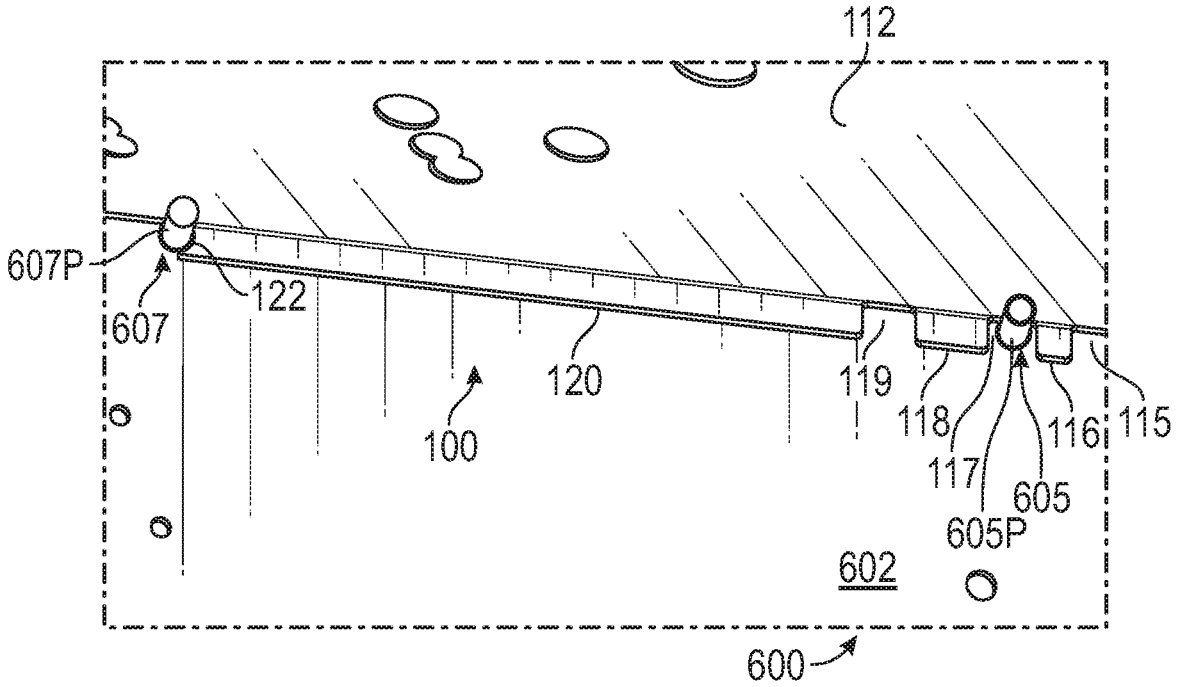
FIG. 8 is a bottom perspective view of a shelf installed in a frame in a flat configuration according to an embodiment of the present disclosure.
Figure 9:
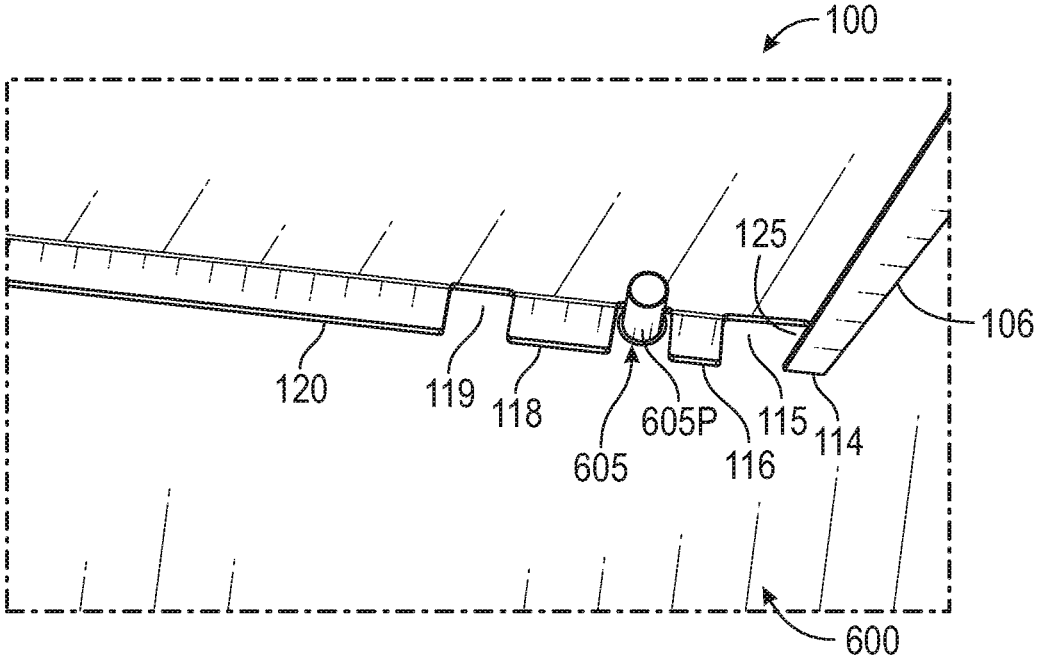
FIG. 9 is a close up bottom perspective view of a shelf installed in a frame in a flat configuration according to an embodiment of the present disclosure.

The tabs and slots function together to allow mounting of the shelf on pins in several configurations (described in greater detail below), including:

(1) flat, with surface 110 facing upward, with curled lip tab 114 facing a front of a cabinet, making laterally extending edge 106 the front edge and laterally extending edge 108 the back edge. Further details of this configuration are shown in FIGS. 7-9.

Figure 10:
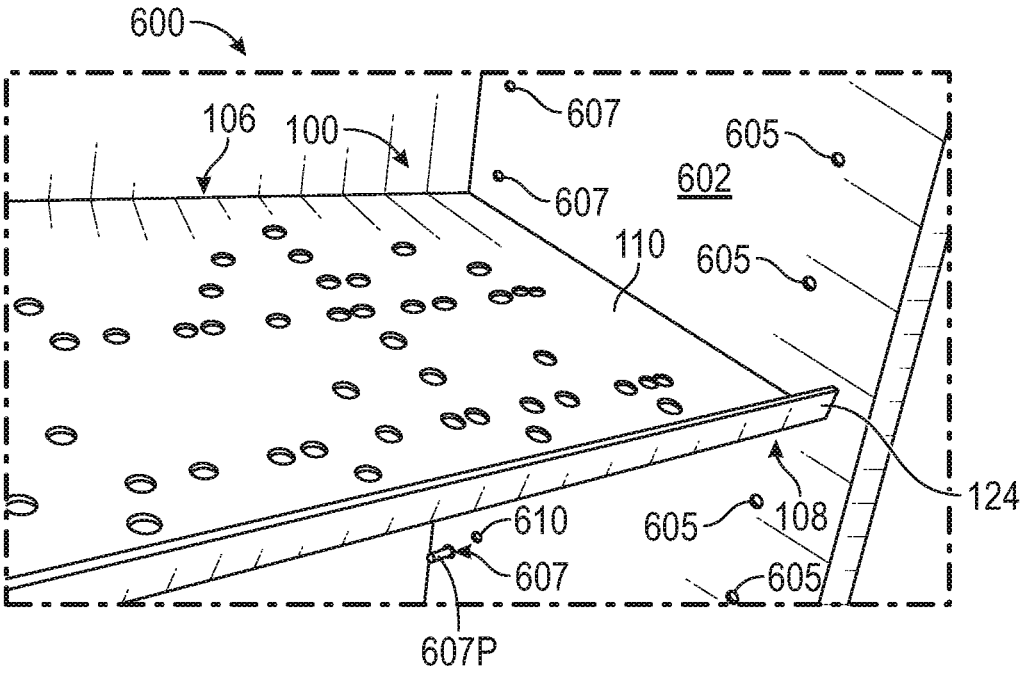
FIG. 10 is a top perspective view of a shelf installed in a frame in a tilted configuration according to an embodiment of the present disclosure.
Figure 11:
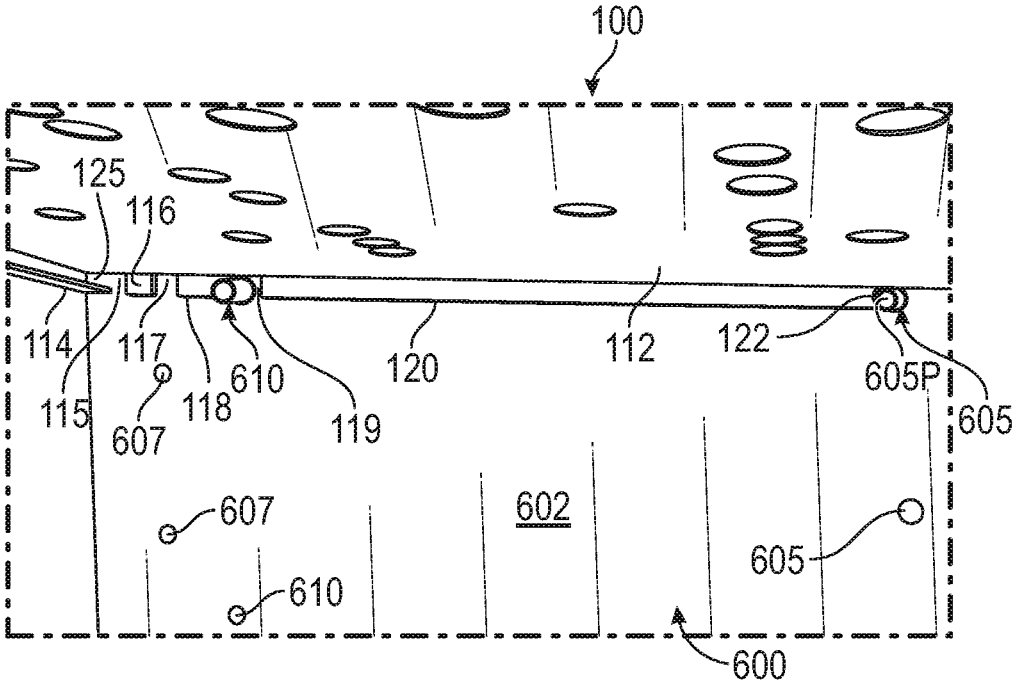
FIG. 11 is a bottom perspective view of a shelf installed in a frame in a tilted configuration according to an embodiment of the present disclosure.

(2) tilted, with surface 110 facing upward, with tab 124 facing a front of a cabinet, making laterally extending edge 108 the front edge and laterally extending edge 106 the back edge, and wherein edge 108 is lower than edge 106, and wherein tab 124 forms a stop to keep items placed on the shelf 100 from rolling or sliding off laterally extending (front in this configuration) edge 108. Further details of this configuration are shown in FIGS. 10-11.

Figure 12:
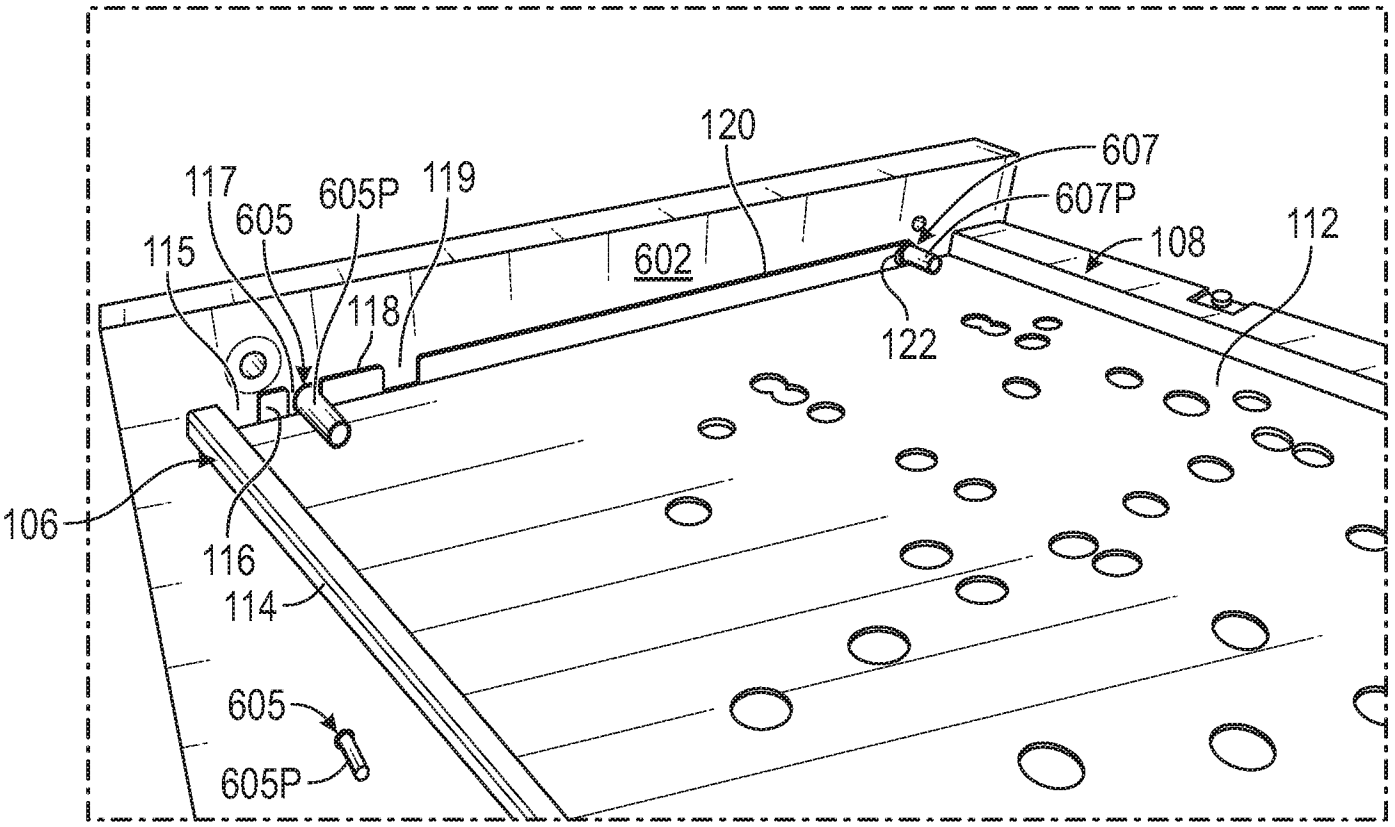
FIG. 12 is a top perspective view of a shelf installed in a frame in an inner cover configuration according to an embodiment of the present disclosure.
Figure 13:
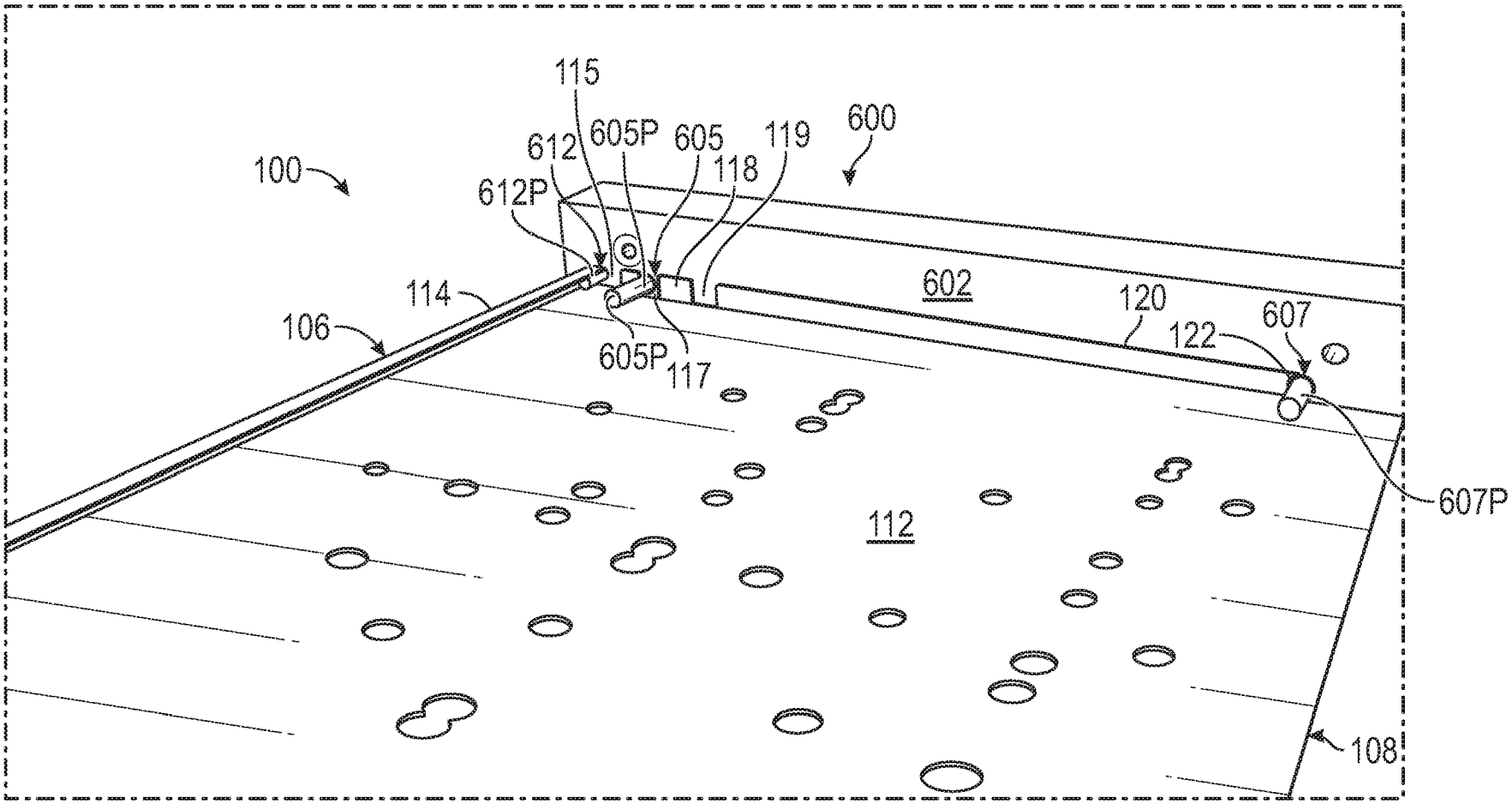
FIG. 13 is a bottom perspective view of a shelf installed in a frame in an inner cover configuration according to an embodiment of the present disclosure.

(3) flat, as an inner cover, with surface 112 facing upward, with curled lip tab 114 facing a front of a cabinet, making laterally extending edge 106 the front edge and laterally extending edge 108 the back edge. Further details of this configuration are shown in FIGS. 12-13.

Figure 2A:
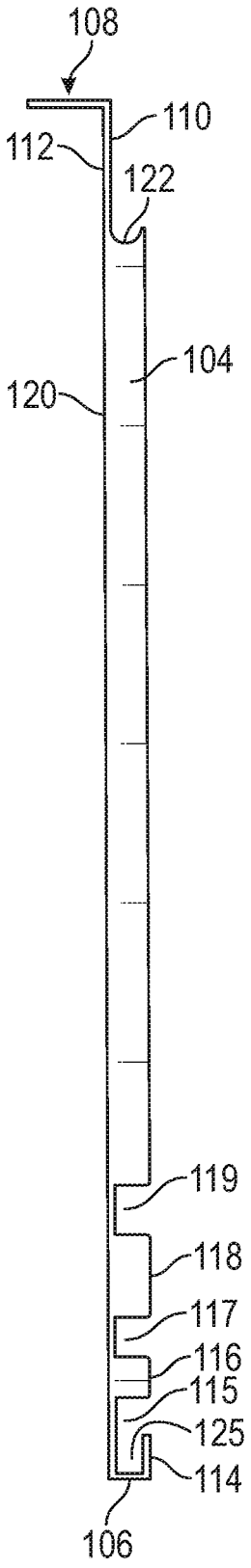
FIGS. 2A and 2B are side elevation views of side edges of the shelf of FIG. 1.
Figure 2B:
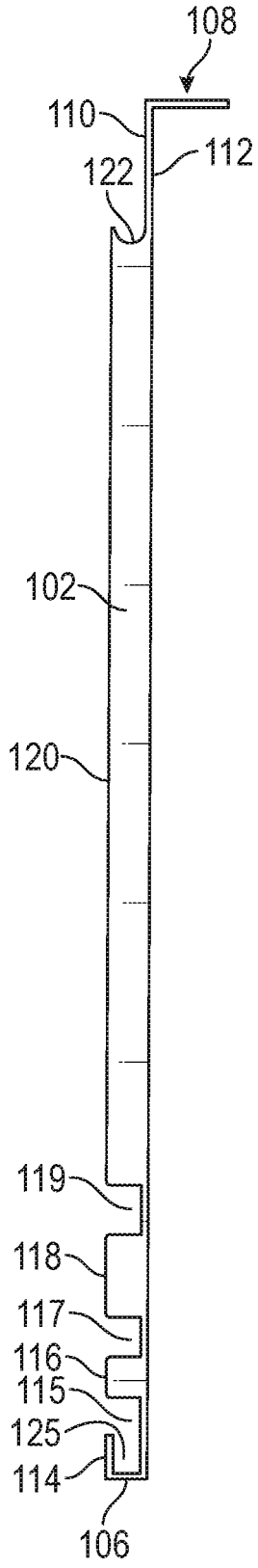

FIGS. 2A and 2B show elevation views of side edges 104 and 102, respectively, and show further details of the tabs 114, 116, 118, 120, and 124; slots 115, 117, 119, curved radius cutout 122, and pocket 125. As may be seen from the figures, and as will be described further herein, curled lip tab 114 provides strength for shelf 100, and is used to capture a cabinet pin when shelf 100 is used as an inner cover.

Figure 3:
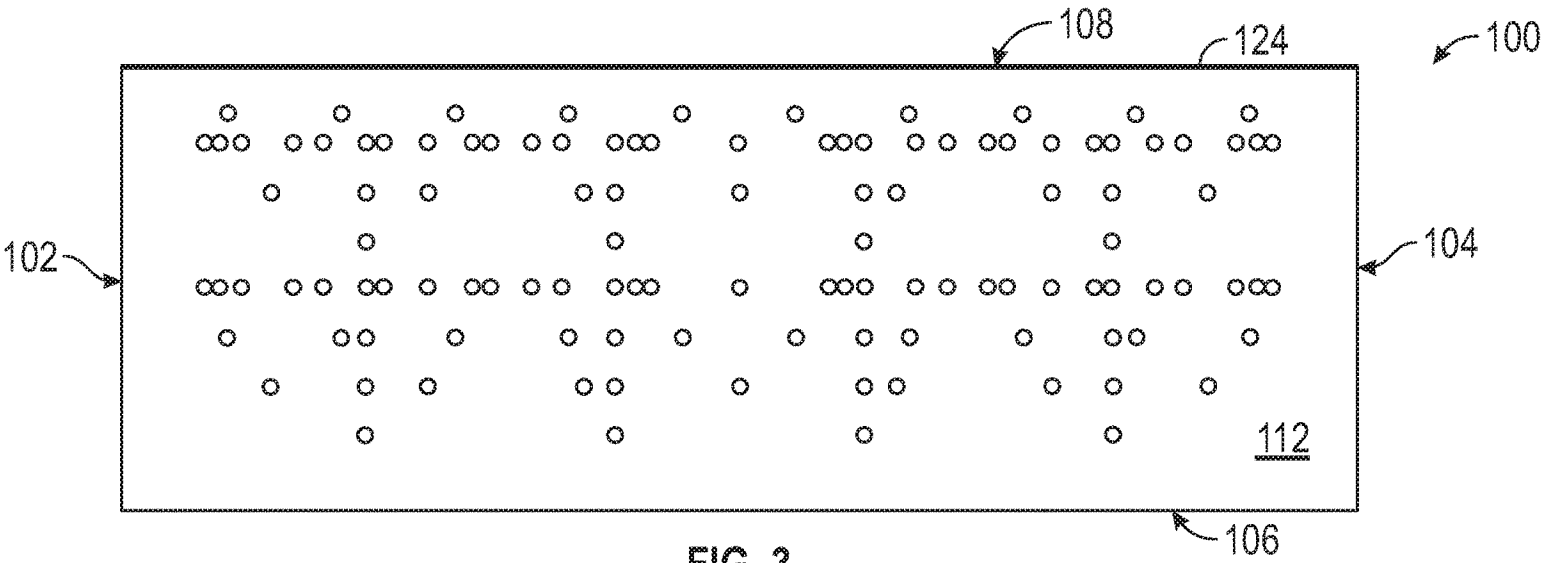
FIG. 3 is a top plan view of the shelf of FIG. 1.
Figure 4:
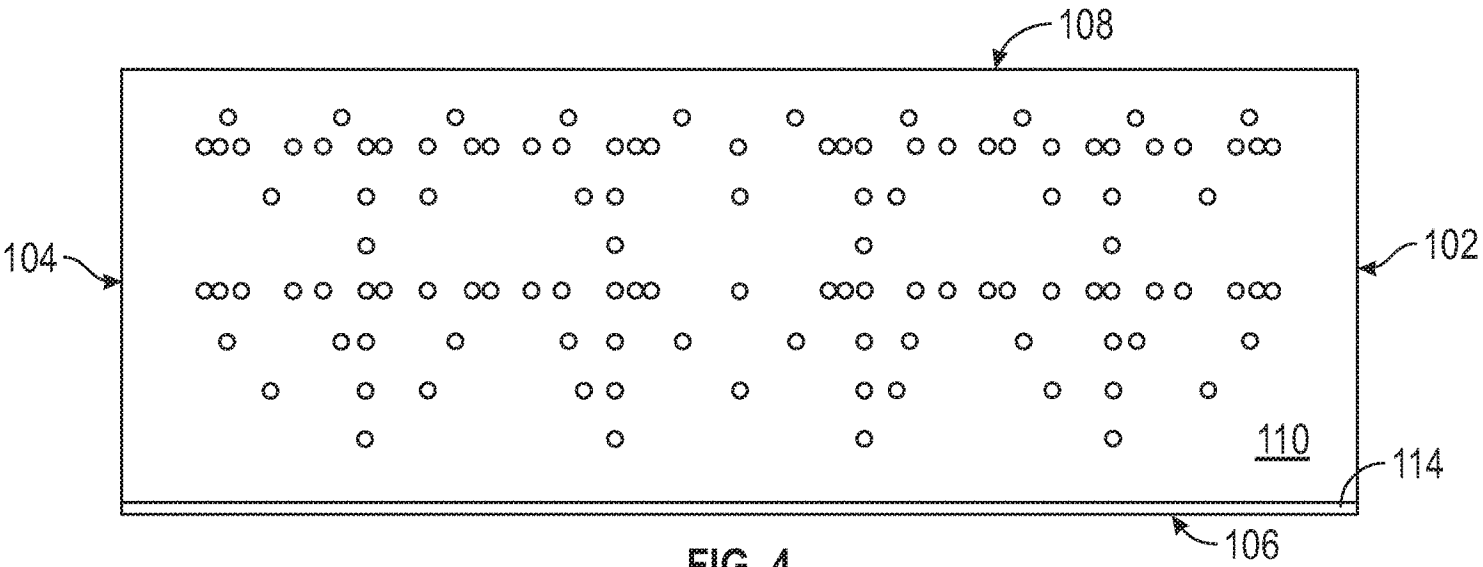
FIG. 4 is a bottom plan view of the shelf of FIG. 1.
Figure 5:
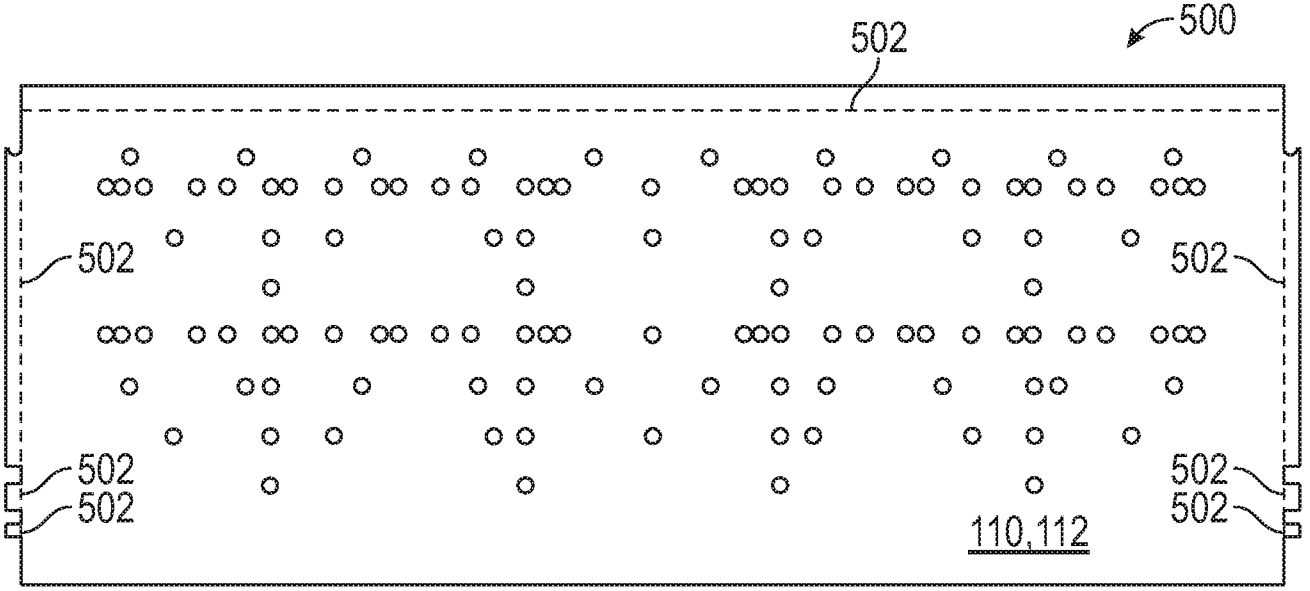
FIG. 5 is a plan view of a shelf prior to bending into its final configuration.

An elevation view of shelf 100 with surface 112 showing is shown in FIG. 3. An elevation view of shelf 100 with surface 110 showing is shown in FIG. 4. An unbent sheet 500 that may be formed by bending at appropriate angles along dashed lines 502 to form shelf 100 is shown in FIG. 5. Depending on the fold process, FIG. 5 may show either surface 110 or surface 112.

Figure 6:
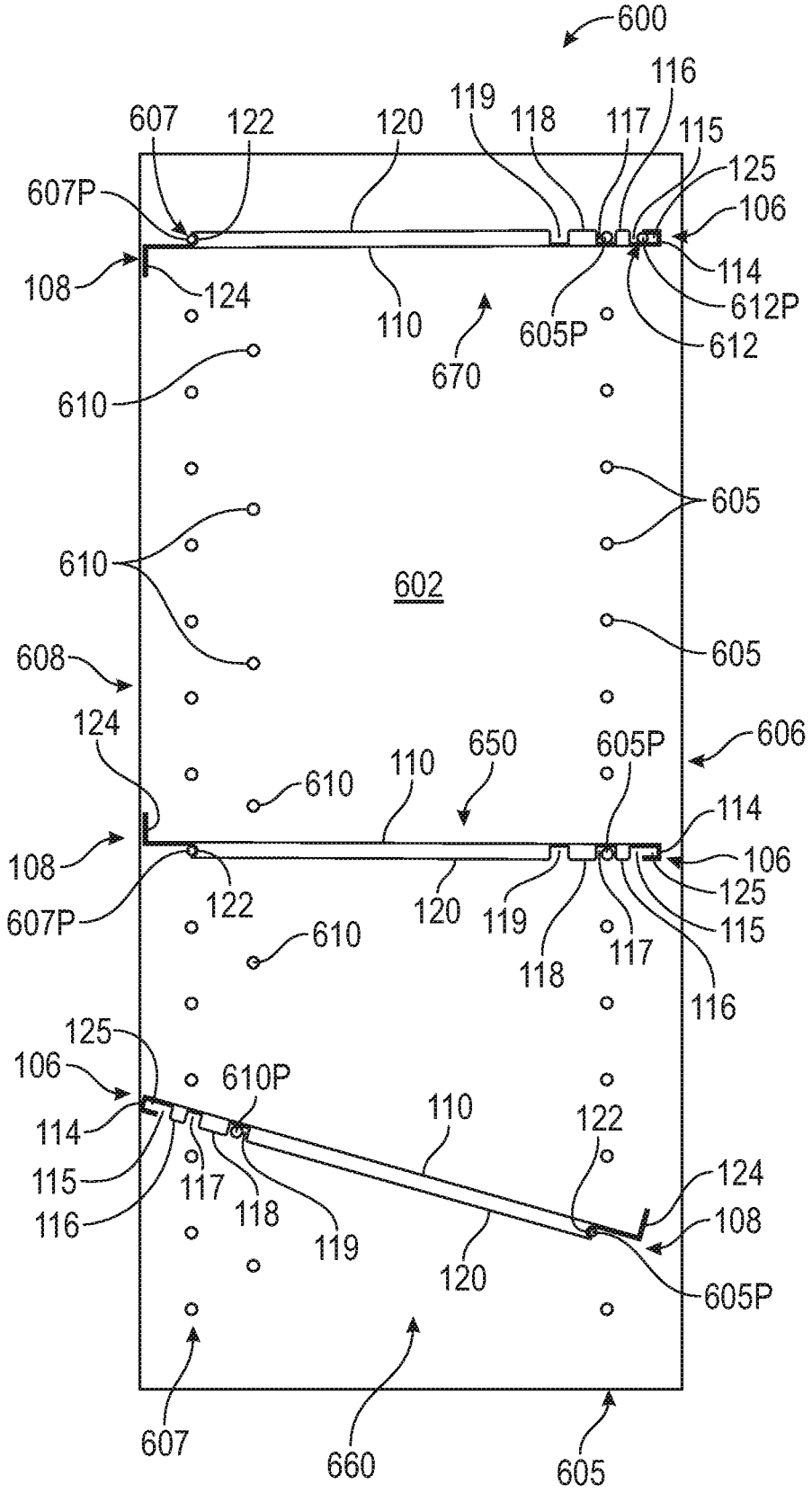
FIG. 6 is an elevation view of a side frame embodiment for a cabinet on which embodiments of the present disclosure may be used.

A portion of a cabinet 600 into which shelves such as shelf 100 may be installed is shown in FIG. 6. One side wall 602 for a cabinet 600 is shown. Wall 602 has a plurality of standard front of the cabinet pin holes 605 at the front side 606 of the cabinet 600, and a matching plurality of back of the cabinet standard pin holes 607 at the back side 608 of the cabinet 600. A plurality of tilted shelf pin holes 610 are positioned between the standard pin holes 605 and 607, and are offset from the pinholes 605, 607 in a vertical orientation. Inner cover pin hole 612 is also provided in wall 602, for use in installation of shelf 100 as an inner cover.

For a level installation configuration of shelf 100, refer to FIG. 6 at 650, and also to FIGS. 7-9. Tabs 116 and 118 define slot 117 therebetween. For installation of shelf 100 in a level configuration orientation, the shelf is positioned with tab 124 facing upward and toward a back 608 of the cabinet 600. Cutout 122 is placed on a back of the cabinet pin 607P in a back of the cabinet pin hole 607 with the front edge 106 above the back of the cabinet pin. When pin 607P engages cutout 122, the edge 106 of shelf 100 is rotated down, about pin 607P, toward pin 605P in front of the cabinet pin hole 605 until slot 117 engages pin 605P in front of the cabinet pin hole 605. In this configuration, radius cutout 122 hinges on and captures back of the cabinet pin 607P in pin hole 607. Shelf 100 is oriented in a level configuration engaging standard pins 605 and 607 in standard pin holes 605 and 607. While one side edge of shelf 100 is shown, it should be understood that the opposite side edge of shelf 100 engages in the same way as the side edge shown.

For a tilted installation configuration of shelf 100, refer to FIG. 6 at 660, and also to FIGS. 10-11. Tabs 118 and 120 define slot 119 therebetween. For installation of shelf 100 in a tilted configuration orientation, the shelf is positioned with tab 124 facing upward and toward a front 606 of the cabinet 600. Cutout 122 is placed on a front of the cabinet pin 605P in a front of the cabinet pin hole 605 with the front edge 106 above the back of the cabinet pin 610P in pin hole 610 immediately above the pin 605P with which cutout 122 is engaged. When pin 605P engages cutout 122, the edge 106 of shelf 100 is rotated down, about pin 605P, toward pin 610P in pin hole 610 until slot 119 engages pin 610P in pin hole 610. In this configuration, radius cutout 122 hinges on and captures front of the cabinet pin 605P in pin hole 605. Shelf 100 is oriented in a tilted configuration with tab 124 extending upward at the front 604 of the cabinet 600, and the back edge (in this configuration) 106 elevated above the front edge (in this configuration) 108 of shelf 100, engaged with standard front of the cabinet pins 605P and tilted shelf pins 610P in pin holes 605 and 610. While one side edge of shelf 100 is shown, it should be understood that the opposite side edge of shelf 100 engages in the same way as the side edge shown.

For an inner cover installation configuration of shelf 100, refer to FIG. 6 at 670, and also to FIGS. 12-13. Tabs 116 and 118 define slot 117 therebetween. Curled lip tab 114 and tab 116 form slot 115 therebetween. Further, the curled lip tab 114 curls under the surface 112 to form a C-shaped opening that is used in this configuration for assisting in the capturing the shelf 100 in the inner cover configuration. For installation of shelf 100 in an inner cover configuration orientation, the shelf is positioned with tab 124 facing downward and toward a back 608 of the cabinet 600. Cutout 122 is placed on a back of the cabinet pin 607P in a back of the cabinet pin hole 607 with the front edge 106 below the back of the cabinet pin 607P in pin hole 607. When pin 607P engages cutout 122, the edge 106 of shelf 100 is rotated up, about pin 607P, toward pin 612P in pin hole 612 until slot 115 engages inner cover pin 612P in inner cover pin hole 612 and retains shelf 100 with inner cover pin 612P engaging the curled under lip tab 114 and pin 607P engaging cutout 122. For front to back retention, in this configuration, pin 605P is placed into front of the cabinet pin hole 605 to engage slot 117. In this configuration, radius cutout 122 hinges on and captures front of the cabinet pin 605P in pin hole 605. Shelf 100 is oriented in a level configuration engaging pins 605P, 607P, and 612P in pin holes 605, 607, 612. While one side edge of shelf 100 is shown, it should be understood that the opposite side edge of shelf 100 engages in the same way as the side edge shown.

Exemplary uses for embodiments of the present disclosure include but are not limited to a management system for artist's supplies; a management system for retail stores, and the like.

It should be noted that the same reference numerals are used in different figures for same or similar elements. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

Product is removed from its subsection when it is desired to be used. This product will become, if not already, the opened product. After use, the opened product may be placed on top of, or in front of, the unopened product remaining in the subsection. This creates a management system where users always use up already opened product completely, before retrieving an unopened product within its subsection.

Embodiments of the present disclosure provide for a shelf 100 that is installable using pins in multiple different configurations depending on the type of use or product that is to be displayed or stored in the cabinet 600. Exemplary uses for embodiments of the present disclosure include but are not limited to a management system for artist's supplies; a management system for retail stores, and the like.

The above-disclosed subject matter is to be considered illustrative, and not restrictive, and the appended claims are intended to cover all such modifications, enhancements, and other embodiments, which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A shelf configurable to be installed in a frame in one of a plurality of multiple orientations including level and tilted, comprising:

a first side edge and a second side edge opposite the first side edge;

a first laterally extending edge extending between the first and second side edges, the first laterally extending edge having a lateral edge tab extending substantially perpendicular to and away from a top surface of the shelf; and a second laterally extending edge, opposite the first laterally extending side edge, and extending between the first and second side edges, the second laterally extending edge having a curled lip tab having a first portion extending substantially perpendicular to and away from a bottom surface of the shelf, and a second portion extending substantially perpendicular to the first portion in a direction toward the first laterally extending edge, to thereby form a pocket between the curled lip tab and the bottom surface of the shelf;

wherein each of the side edges has a plurality of tabs extending substantially perpendicular to and away from the bottom surface of the shelf, the plurality of tabs defining a plurality of slots between respective tabs, and a slot between the curled lip tab and one of the tabs, and wherein a tab most distal from the second laterally extending edge has a curved radius therein shaped to engage a pin.

2. A cabinet, comprising:

a frame, comprising a top pan and a bottom pan, and a pair of sides coupled to the top pan and the bottom pan to form the frame, wherein at least one of the top pan and the bottom pan comprises a shelf according to claim 1; and a shelf adjustably mounted in the frame in one of a substantially level or a slanted orientation, the shelf comprising the shelf of claim 1.

3. A method of mounting a shelf into a cabinet, comprising:

mounting a shelf on mounting pins in the cabinet, wherein the shelf comprises:

a first side edge and a second side edge opposite the first side edge;

a first laterally extending edge extending between the first and second side edges, the first laterally extending edge having a lateral edge tab extending substantially perpendicular to and away from a top surface of the shelf;

a second laterally extending edge, opposite the first laterally extending side edge, and extending between the first and second side edges, the second laterally extending edge having a curled lip tab having a first portion extending substantially perpendicular to and away from a bottom surface of the shelf, and portion extending substantially perpendicular to the first portion in a direction toward the first laterally extending edge, to thereby form a pocket between the curled lip tab and the bottom surface of the shelf;

wherein each of the side edges has a plurality of tabs extending substantially perpendicular to and away from the bottom surface of the shelf, the plurality of tabs defining a plurality of slots between respective tabs, and a slot between the curled lip tab and one of the tabs, and wherein a tab most distal from the second laterally extending edge has a curved radius therein shaped to engage a pin;

wherein mounting comprises engaging front and back cabinet pins level with each other with the curved radius and at least one of the slots.

4. The method of claim 3, wherein mounting is accomplished by:

positioning the lip of the first laterally extending edge facing upward and toward a back of the cabinet;

placing the curved radius on a first pair of mounting pins positioned in first and second opposite side panels of the cabinet near a back thereof;

positioning the second laterally extending edge above the first pair of mounting pins; and rotating the second laterally extending edge down, pivoting the shelf about the curved radius, to engage a second pair of mounting pins positioned in the first and the second opposite side panels of the cabinet near a front thereof.

5. The method of claim 4, wherein slots of the shelf engage the second pair of mounting pins.

6. The method of claim 4, wherein the first pair of mounting pins and the second pair of mounting pins are at a same height and the shelf is mounted in a level position when engaged with the first and second pairs of mounting pins, the lateral edge tab of the first laterally extending edge forming a back retaining element for items placed on the shelf.

7. The method of claim 3, wherein mounting is in a tilted position and is accomplished by:

positioning the lateral edge tab of the first laterally extending edge facing upward and toward a front of the frame;

placing the curved radius on a first pair of mounting pins positioned in first and second opposite side panels of the cabinet near a front thereof;

positioning the second laterally extending edge above the first pair of mounting pins; and rotating the second laterally extending edge down, pivoting the shelf about the curved radius, to engage a second pair of mounting pins positioned in the first and the second opposite side panels of the cabinet near a rear thereof.

8. The method of claim 7, wherein slots of the shelf engage the second pair of mounting pins.

9. The method of claim 7, wherein the first pair of mounting pins are at a lower height than the second pair of mounting pins, and wherein the shelf is installed in a tilted position, the lateral edge tab of the first laterally extending edge forming a front retaining element for items placed on the shelf.

10. The method of claim 3, wherein mounting is as a top inner cover installation for the cabinet, and is accomplished by:

positioning the lateral edge tab of the first laterally extending edge facing downward and toward a back of the frame;

placing the curved radius on a first pair of mounting pins positioned in first and second opposite side panels of the cabinet near a back thereof;

positioning the second laterally extending edge below the first pair of mounting pins;

rotating the second laterally extending edge up, pivoting the shelf about the curved radius, to engage the pocket with a second pair of mounting pins positioned in the first and the second opposite side panels of the cabinet near a front thereof; and placing a third pair of mounting pins, one on each opposite side of the cabinet, in slots of the shelf to secure against front to back motion of the shelf.

11. A cabinet, comprising a frame including a top pan and a bottom pan, and a pair of frame sides coupled to the top pan and the bottom pan, the pair of frame sides having a plurality of openings therein to accommodate mounting pins in various configurations; and at least one shelf mountable in multiple positons to the frame on mounting pins in the frame, the shelf comprising:

a first side edge and a second side edge opposite the first side edge;

a first laterally extending edge extending between the first and second side edges, the first laterally extending edge having a lateral edge tab extending substantially perpendicular to and away from a top surface of the shelf; and a second laterally extending edge, opposite the first laterally extending side edge, and extending between the first and second side edges, the second laterally extending edge having a curled lip tab having a first portion extending substantially perpendicular to and away from a bottom surface of the shelf, and a second portion extending substantially perpendicular to the first portion in a direction toward the first laterally extending edge, to thereby form a pocket between the curled lip tab and the bottom surface of the shelf;

wherein each of the side edges has a plurality of tabs extending substantially perpendicular to and away from the bottom surface of the shelf, the plurality of tabs defining a plurality of slots between respective tabs, and a slot between the first and second lips and one of the tabs, and wherein a tab most distal from the second laterally extending edge has a curved radius therein shaped to engage a pin.

12. The cabinet of claim 11, wherein the plurality of slots accommodate the mounting pins to mount the shelf within the frame.

13. The cabinet of claim 12, wherein the shelf is mounted horizontally with the lateral edge tab of the first laterally extending edge toward a back of the cabinet and extending upward.

14. The cabinet of claim 12, wherein the shelf is mounted tilted with the lateral edge tab of the first laterally extending edge lower than the curled lip tab of the second laterally extending edge, and the lateral edge tab of the first laterally extending edge toward a front of the cabinet and extending upward.

15. The cabinet of claim 12, wherein the shelf is mounted horizontally as a top inner pan of the cabinet with the lip of the first laterally extending edge toward a back of the cabinet and extending downward.

16. The cabinet of claim 11, wherein at least one of the top pan and the bottom pan comprises a shelf of the at least one shelf.

* * * * *